US010144571B2

(12) United States Patent
Gorick

(10) Patent No.: US 10,144,571 B2
(45) Date of Patent: Dec. 4, 2018

(54) STORAGE AND TRAVEL CONTAINER FOR DISPOSABLE TUBES, SUCH AS GREASE TUBES

(71) Applicant: Christopher D. Gorick, Susquehanna, PA (US)

(72) Inventor: Christopher D. Gorick, Susquehanna, PA (US)

( * ) Notice: Subject to any disclaimer, the term of this patent is extended or adjusted under 35 U.S.C. 154(b) by 154 days.

(21) Appl. No.: 15/059,761

(22) Filed: Mar. 3, 2016

(65) Prior Publication Data

US 2016/0264335 A1 Sep. 15, 2016

Related U.S. Application Data

(60) Provisional application No. 62/130,523, filed on Mar. 9, 2015.

(51) Int. Cl.

| | |
|---|---|
| ***B65D 85/14*** | (2006.01) |
| ***B65D 85/72*** | (2006.01) |
| ***B65D 81/02*** | (2006.01) |
| ***B65D 85/62*** | (2006.01) |
| ***B25H 3/02*** | (2006.01) |
| ***B65D 43/16*** | (2006.01) |
| ***B65D 43/22*** | (2006.01) |

(52) U.S. Cl.

CPC ..... *B65D 81/02* (2013.01); *B25H 3/025* (2013.01); *B65D 43/164* (2013.01); *B65D 43/22* (2013.01); *B65D 85/62* (2013.01)

(58) Field of Classification Search

CPC ..... B65D 43/16; B65D 81/02; B65D 85/62

USPC ..... 206/1.5, 277, 384, 446, 562; 211/87.01; 220/324, 326, 476, 480, 501, 810

See application file for complete search history.

(56) References Cited

U.S. PATENT DOCUMENTS

| | | | | |
|---|---|---|---|---|
| 748,119 | A * | 12/1903 | Thiele | B65F 1/12 220/476 |
| 1,851,512 | A * | 3/1932 | Hinkley | A47G 29/14 220/480 |
| 2,292,626 | A * | 8/1942 | Ferguson | A61L 2/26 206/210 |
| 5,069,336 | A * | 12/1991 | Mauthe | E21D 20/026 206/219 |
| 5,080,240 | A * | 1/1992 | Williams | B25H 3/04 211/13.1 |
| 6,102,215 | A * | 8/2000 | Guida | B25H 3/04 206/384 |
| 8,118,137 | B2 | 2/2012 | Cerveny | |
| 8,469,188 | B1 * | 6/2013 | Vitale | B25H 3/00 206/277 |
| 2008/0088144 | A1 * | 4/2008 | Crown | A45F 5/10 294/146 |
| 2008/0283431 | A1 | 11/2008 | Joss et al. | |
| 2009/0065532 | A1 | 3/2009 | Lafond | |

(Continued)

*Primary Examiner* — Luan K Bui

(74) *Attorney, Agent, or Firm* — Wendy W. Koba

(57) ABSTRACT

A storage container is particularly configured to house one or more disposable tubes, such as grease tubes, in a manner where the tubes are protected from the environment and restrained from movement. That is, the tubes are restrained from "rolling around" within a vehicle, for example. The container is preferably configured to store the tubes in a vertical position, with the top, dispensing end of the tubes facing up, thus, ensuring that any entrained air will rise to the top of the tube.

4 Claims, 3 Drawing Sheets

(56) References Cited

U.S. PATENT DOCUMENTS

| | | | | |
|---|---|---|---|---|
| 2009/0071963 | A1* | 3/2009 | Johnson | A47B 77/18<br>220/476 |
| 2011/0180437 | A1* | 7/2011 | Alt | B25H 3/02<br>206/372 |
| 2013/0000257 | A1* | 1/2013 | Waltrip | B65D 85/30<br>53/449 |

* cited by examiner

STORAGE AND TRAVEL CONTAINER FOR DISPOSABLE TUBES, SUCH AS GREASE TUBES

CROSS-REFERENCE TO RELATED APPLICATIONS

This application claims the benefit of U.S. Provisional Application Ser. No. 62/130,523, filed Mar. 9, 2015 and herein incorporated by reference.

TECHNICAL FIELD

The present invention relates to a storage container and, more particularly, to a storage and travel container useful in transporting grease tubes (for example) in a manner that prevents damage to the tubes.

BACKGROUND OF THE INVENTION

There are various types of liquid material (such as grease that is used as a lubricant, or caulk that is used for a sealant) that are sold in "throw-away" (i.e., disposable) tubes (usually made of cardboard) that are loaded into dispensers for actual use. In most cases, people will want to keep a supply of extra tubes close by, since any particular job may require the use of several tubes.

Inasmuch as these tubes are typically made of cardboard, they can be easily damaged. Most people keep the extra tubes in their car, truck or the like. As a result, these tubes are subject to damage as they roll around, bump into other things, etc. Indeed, when grease tubes are stored on heavy equipment vehicles (such as tractors), it is likely that the tubes may be thrown from the vehicle.

These tubes can be very expensive and, in any case, there is often great waste in these products, since damage to cardboard tubes is inevitable.

SUMMARY OF THE INVENTION

The problems associated with the transport of these cardboard tubes are addressed by the present invention, which relates to a storage container and, more particularly, to a storage and travel container useful in transporting disposable tubes (such as grease tubes, for example) in a manner that prevents damage to the tubes.

In accordance with an exemplary embodiment of the present invention, a storage container is particularly configured to house one or more disposable tubes (such as grease tubes) in a manner where the tubes are protected from the environment and restrained from movement (i.e., no longer "rolling around" within a vehicle, for example). The container is preferably configured to store the tubes in a vertical position, with the top end of the tubes (i.e., the dispensing end) facing up, thus, ensuring that any entrained air will rise to the top of the tube.

One exemplary embodiment of the present invention takes the form of a storage container for supporting disposable tubes in an upright manner, the storage container comprising an interior storage area formed to support a plurality of disposable tubes utilized with an applicator gun, the interior storage area comprising a plurality of cylindrical openings, each opening formed of a length sufficient for surrounding a disposable tube and supporting the disposable tube in an upright manner.

Other and further embodiments and aspects of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

A container suitable for storing, disposable, fluid-containing tubes in a safe and secure manner is described in the following paragraphs. The tubes themselves are typically formed of a cardboard (or light plastic) material that is rather fragile and is subject to puncture.

Figure 1:
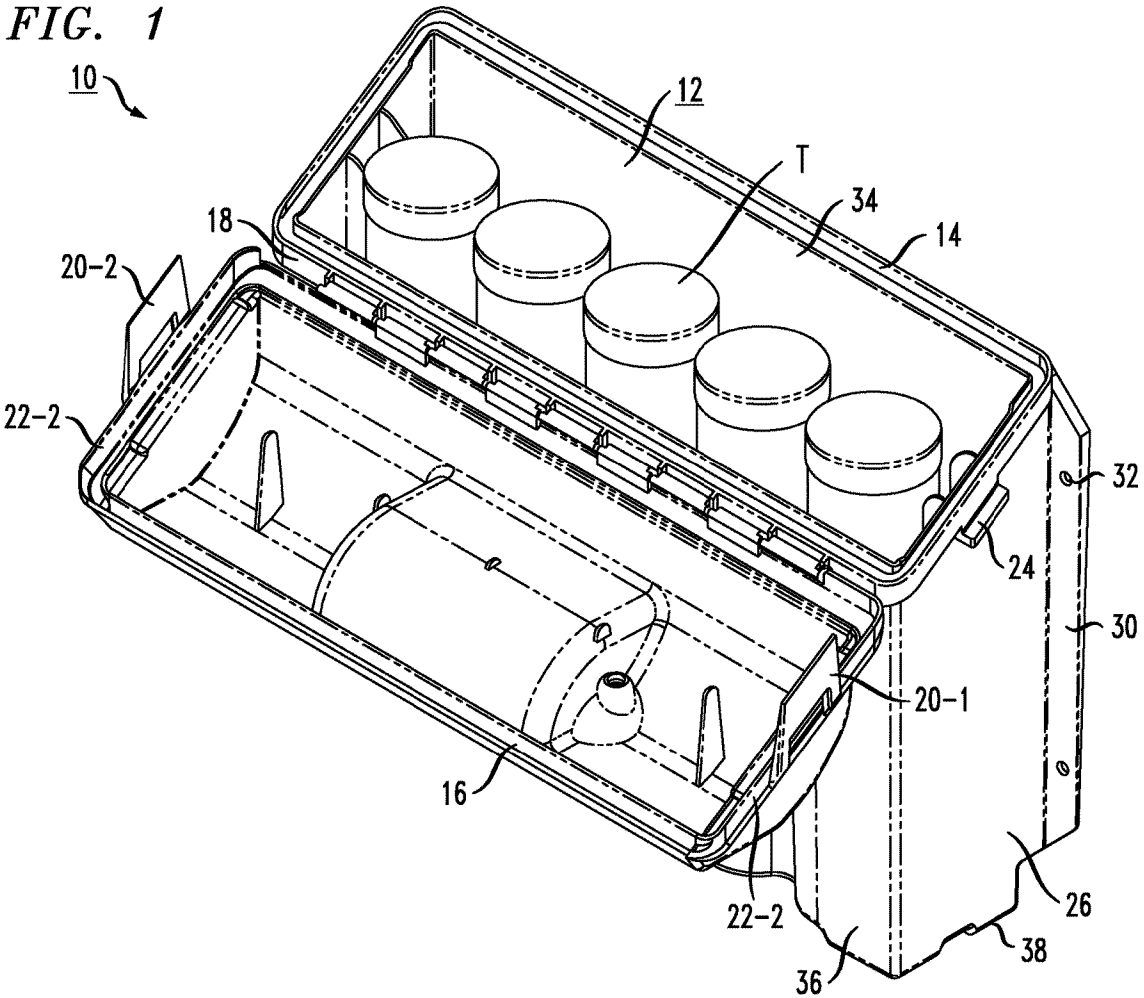
FIG. 1 is an isometric view of an exemplary container in an open position.
Figure 2:
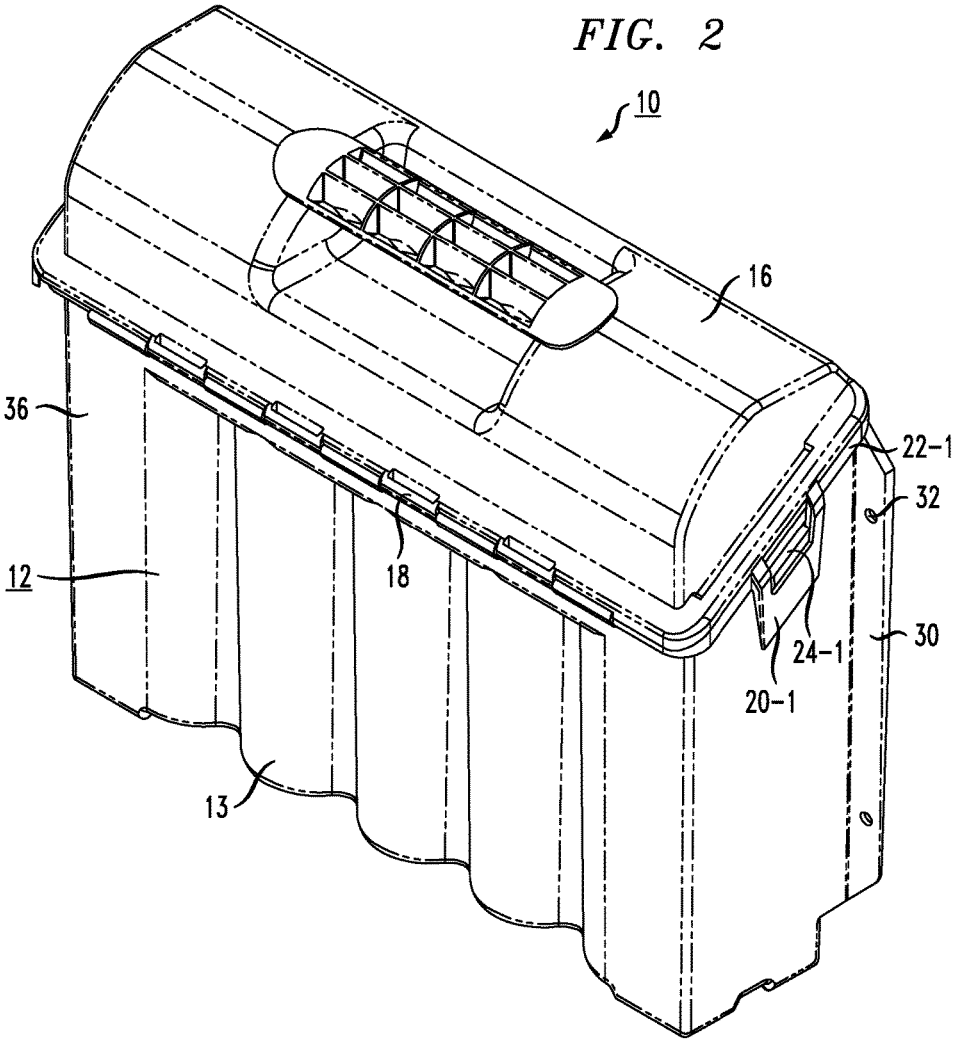
FIG. 2 illustrates the inventive container in a closed position.

FIG. 1 is an isometric view of an exemplary container 10 in an "open" position, and FIG. 2 illustrates container 10 in a "closed" position. Container 10 is shown as comprising an interior storage area 12 for supporting a number of tubes (shown as "T"). While the configuration shown in FIG. 1 is formed to house a set of five tubes, it is to be understood that this is merely one example; container 10 of the present invention may be formed to house any number of tubes (and may also be formed to house more than one 'row' of tubes). Preferably, interior storage area 12 is formed of a molded material that defines a number of cylindrical openings 13, each opening designated for holding a separate tube. This "molded" configuration of storage area 12 is best seen in FIG. 2.

Advantageously, the configuration of container 10 is designed to store the tubes in an "upright" direction, that is, with the dispensing end of the tube toward the top surface 14 of container 10. For example, in order for a grease tube to function efficiently, it should be stored upright. All grease tubes have a little air in them, so if stored upright the air will escape as soon as placed in a gun and started to be used—that is the air will be immediately pushed out and the grease will immediately start to be dispensed. In conventional situations where the extra tubes lay on their sides, the trapped air creeps down along the length of the tube, and may form a "bubble" within the grease when first placed in, a gun, for use—an undesirable result. In one embodiment of the present invention, openings 13 may be formed to ensure that the tubes are placed with the bottoms of the tubes toward the bottom of container 10 (for example, openings 13 may be formed to have a somewhat larger top diameter for supporting a cap on a tube, but the cap is too large to enter opening 13 if one tried to store the tube "upside down").

Preferably, container 10 includes a lid 16 which is attached to storage area 12 via a hinged connection 18. A clamping mechanism 20 is formed on lid 16 and used to maintain lid 16 in place over storage area 12. FIG. 2 shows container 10 in the "closed" position, with lid 16 in place over storage area 12. As shown, clamping mechanism 20 takes the form of a pair of handles 20-1 and 20-2 formed on opposing side surfaces 22-1 and 22-2 of lid 16. Storage area 12 is formed to include a pair of extensions 24 along side walls 26 (only one extension visible in the isometric views of FIGS. 1 and 2). Thus, when lid 16 is rotated via hinge 18 to be in place over storage area 12, the pair of handles 20-1 and 20-2 will clamp over associated extensions 24-1 and 24-2, and maintain lid 16 securely in place.

In accordance with the present invention, container 10 is intended to be mounted onto a surface, thus maintaining container 10 in a fixed position and keeping the enclosed tubes securely in place. In particular, container 10 is shown as including a flanged mounting support 30 with a number of apertures 32. The apertures 32 are used as attachment areas for mounting container 10 at a desired location. For example, container 10 may be mounted onto a structure in a pickup truck (8 such as on a tool box included within the truck), a tractor storage area, in a barn, garage, or the like. In a preferred embodiment, mounting support is attached along a surface 34 of storage area 12 that opposes the surface 36 where hinge 18 is formed. This location of mounting surface 30 with respect to hinge 18 allows for container 10 to easily be opened and closed without being obstructed by the wall area to which container 10 has been mounted.

Figure 3:
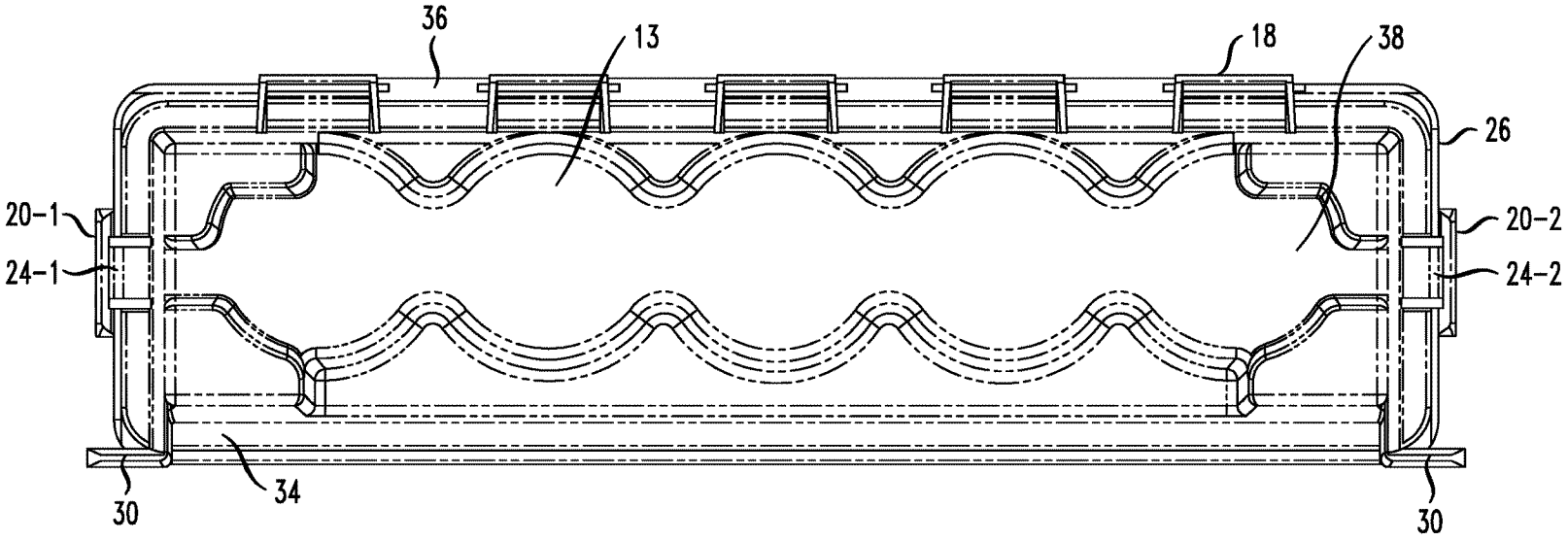
FIG. 3 is a view of the bottom surface of the inventive container.

FIG. 3 is a view of bottom surface 38 of container 10, and shows in phantom the number of separate openings 13 where the tubes will be placed. That is, as mentioned above, storage area 12 is preferably formed of a molded material and includes a number of cylindrical openings 13 for supporting the tubes. The view of FIG. 3 illustrates the bottom termination of each of these cylindrical openings 13. The position of mounting surface 30 with respect to hinge 18 is also visible in this view.

While the above description has describes the features of the present invention with reference to a grease tube, it is to be understood that the container of the present invention may be used for housing any type of material that is stored in tubes, where the material may be in the form of a liquid, powder, gas, etc. Additionally, while most embodiments of the present invention are preferably formed of a moldable plastic material, it is possible to form the container of this invention out of any desirable material (including any acceptable type of metal, alloy, etc.).

Indeed, it is to be understood that the preceding description is given merely by way of illustration and not in limitation of the invention and that various modifications may be made thereto without departing from the spirit and scope of the invention as claimed.

What is claimed is:

1. A storage container for supporting disposable tubes in an upright manner, the storage container comprising An essentially rectangular outer housing including a flat rear wall;

an interior storage area formed within the outer housing to support a plurality of disposable tubes utilized with an applicator gun, the interior storage area comprising a plurality of separate cylindrical openings with each opening having a bottom diameter smaller than a top diameter, each opening formed to define a closed compartment of a length sufficient for surrounding a disposable tube and supporting the disposable tube in an upright manner; and a pair of flanged surfaces extending outwardly beyond opposing sides of the flat rear wall and parallel to the plurality of cylindrical openings, the pair of flanged surfaces include a plurality of apertures for attaching the flat rear wall of the storage container to a vertical surface.

2. The storage container as defined in claim 1 wherein the storage container further comprises a hinged lid attached to the outer housing for covering the interior storage area and preventing exposure of top ends of contained disposable tubes.

3. The storage container as defined in claim 2 wherein the hinged lid includes a pair of clamping mechanisms for locking the hinged lid in place on an outer portion of the outer housing.

4. The storage container as defined in claim 1 wherein the interior storage area is formed of a moldable plastic material.

* * * * *